US005194037A

United States Patent [19]

Jones et al.

[11] Patent Number: 5,194,037

[45] Date of Patent: * Mar. 16, 1993

[54] DISC-TYPE COIN SORTING MECHANISM FOR SORTING COINS BY RADIAL LOCATIONS OF THE INNER EDGES OF THE COINS

[75] Inventors: John E. Jones, Winnetka; James M. Rasmussen, Chicago, both of Ill.

[73] Assignee: Cummins-Allison Corp., Mount Prospect, Ill.

[ * ] Notice: The portion of the term of this patent subsequent to Sep. 16, 2008 has been disclaimed.

[21] Appl. No.: 248,277

[22] Filed: Sep. 21, 1988

Related U.S. Application Data

[63] Continuation-in-part of Ser. No. 34,271, Apr. 1, 1987, abandoned.

[51] Int. Cl.[5] ..... G07D 3/16

[52] U.S. Cl. ..... 453/10

[58] Field of Search ..... 453/3, 9, 6, 10, 12, 453/13; 209/915, 917, 918, 919, 922, 539; 221/167, 168, 169; 198/392

[56] References Cited

U.S. PATENT DOCUMENTS

| | | | |
|---|---|---|---|
| 574,528 | 1/1897 | Elder et al. | 133/3 C |
| 1,894,190 | 1/1933 | Myers . | |
| 1,979,659 | 11/1934 | Zierick | 133/3 |
| 2,231,642 | 2/1941 | Seemel | 133/8 |
| 2,348,936 | 5/1944 | Sprenger . | |
| 2,351,197 | 6/1944 | Francis | 453/10 |
| 2,835,260 | 5/1958 | Buchholz | 133/8 |
| 2,906,276 | 9/1959 | Blanchette et al. | 133/3 A |
| 2,977,961 | 4/1961 | Buchholz et al. | 133/3 |
| 3,065,841 | 11/1962 | Stover . | |
| 3,246,658 | 4/1966 | Buchholz | 133/10 |
| 3,771,538 | 11/1973 | Reis | 133/3 D |
| 3,795,252 | 3/1974 | Black . | |
| 3,837,139 | 9/1974 | Roseberg | 133/8 R |

(List continued on next page.)

FOREIGN PATENT DOCUMENTS

| | | |
|---|---|---|
| 0061302 | 3/1982 | European Pat. Off. . |
| 0125132 | 11/1984 | European Pat. Off. . |
| 0151776 | 12/1984 | European Pat. Off. . |
| 0149906 | 7/1985 | European Pat. Off. . |
| 1137884 | 10/1962 | Fed. Rep. of Germany . |
| 2012863 | 10/1971 | Fed. Rep. of Germany . |
| 2515837 | 10/1975 | Fed. Rep. of Germany . |
| 2296361 | 8/1976 | France . |
| 650871 | 8/1985 | Switzerland . |
| 908999 | 8/1961 | United Kingdom . |
| 1288674 | 4/1970 | United Kingdom . |

*Primary Examiner*—F. J. Bartuska
*Attorney, Agent, or Firm*—Arnold, White & Durkee

[57] ABSTRACT

A coin sorter for sorting coins in terms of their diameter comprising a rotatably mounted coin-carrying disc having a resilient top surface onto which coins may be fed; a drive motor for rotating the disc; a guide plate having a central opening and a configured lower surface positioned over and closely adjacent to the disc, and wherein the configured surface includes an inner recess within which coins are free to move radially, and the inner recess extends outwardly from the central opening, and guide plate forming a referencing region for receiving the coins from the inner recess and pressing them against the resilient top surface of the coin-carrying disc while engaging the radially outer edges of the coins of all denominations and moving the coins radially inwardly as the coins are advanced circumferentially so that the radially outer edges of the coins of all denominations are positioned at a common radial location, whereby the radially inner edges of the coins are positioned at different radial locations determined by the diameters of the respective coins, and sorting recesses disposed around the outer periphery of the guide plate for sorting coins of different denominations according to the different radial locations of the radially inner edges of the coins of different denominations, the sorting recesses ejecting coins of a common denomination at a common circumferential location on the periphery of the guide plate.

15 Claims, 5 Drawing Sheets

U.S. PATENT DOCUMENTS

| | | | |
|---|---|---|---|
| 3,939,954 | 2/1976 | Collins . | |
| 3,998,237 | 12/1976 | Kressin et al. . | |
| 4,086,928 | 5/1978 | Ristvedt et al. | 133/3 A |
| 4,088,143 | 8/1978 | Bezsilko | 133/1 |
| 4,098,280 | 7/1978 | Restvedt et al. | 133/3 A |
| 4,108,187 | 5/1978 | Bezsilko | 133/1 |
| 4,111,216 | 9/1978 | Brisebarre | 133/3 A |
| 4,234,003 | 11/1980 | Ristvedt et al. | 133/3 A |
| 4,360,034 | 11/1982 | Davila et al. | 133/3 A |
| 4,444,212 | 4/1984 | Ristvedt et al. | 133/3 A |
| 4,506,685 | 3/1985 | Childers et al. | 133/3 A |
| 4,531,531 | 7/1985 | Johnson et al. | 133/3 A |
| 4,543,969 | 10/1985 | Rasmussen | 133/3 A |
| 4,549,561 | 10/1985 | Johnson et al. | 133/3 A |
| 4,557,282 | 12/1985 | Childers | 453/6 |
| 4,564,036 | 1/1986 | Ristvedt | 133/3 A |
| 4,564,037 | 1/1986 | Childers et al. | 133/3 A |
| 4,570,655 | 2/1986 | Raterman | 133/3 A |
| 4,586,522 | 5/1986 | Taipale et al. | 453/10 |
| 4,607,649 | 8/1986 | Taipale et al. | 133/3 C |
| 4,731,043 | 3/1988 | Ristvedt et al. | 453/6 |
| 4,753,624 | 6/1988 | Adams et al. | 453/10 |
| 4,775,354 | 10/1988 | Rasmussen et al. | 453/10 |

DISC-TYPE COIN SORTING MECHANISM FOR SORTING COINS BY RADIAL LOCATIONS OF THE INNER EDGES OF THE COINS

CROSS-REFERENCE TO RELATED APPLICATION

This application is a continuation-in-part of U.S. application Ser. No. 034,271, filed Apr. 1, 1987, now abandoned.

FIELD OF THE INVENTION

The present invention relates generally to coin sorting devices and, more particularly, to coin sorters of the type which use a resilient disc rotating beneath a stationary sorting head for sorting coins of mixed denominations.

INVENTION

It is a primary object of the present invention to provide an improved coin sorter of the foregoing type which presses the coins into the resilient disc for positive control throughout the referencing, sorting and ejection movements, but does not require any depressors, plows or other auxiliary devices to extract the coins from the pressure exerted thereon by the resilient disc at the locations designated for ejection of coins of different denominations. In this connection, a related object of the invention is to provide such an improved coin sorter which is simple and inexpensive to manufacture, and which can be accommodated in a small space.

Another related object of the invention is to provide such an improved coin sorter which can be quickly stopped by braking each time a preselected number of coins of the same denomination have been ejected from the sorter.

It is another important object of this invention to provide an improved coin sorter which quickly moves the coins to their outermost radial positions in the sorting mechanism by centrifugal force, and then presses the coins into the resilient disc and maintains that pressure throughout the referencing, sorting and ejecting movements.

A further object of this invention is to provide an improved coin sorter which can be made small enough for countertop use and yet have the capability of sorting six or more denominations of coins.

Other objects and advantages of the invention will be apparent from the following detailed description and the accompanying drawings.

DESCRIPTION OF THE PREFERRED EMBODIMENT

Figures 1, 2:
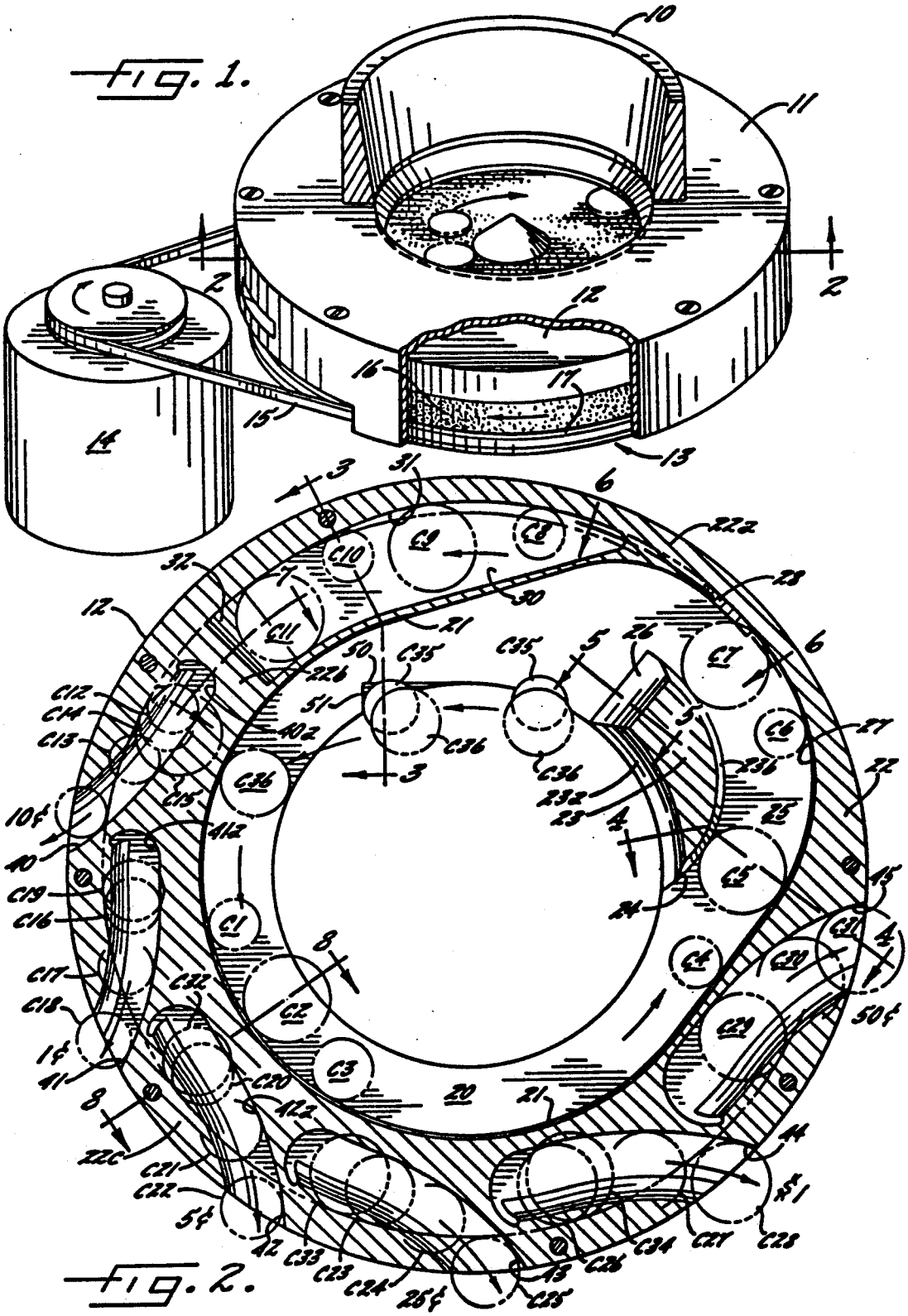
FIG. 1 is perspective view of a coin sorter embodying the present invention, with portions thereof broken away to show the internal structure.
FIG. 2 is an enlarged horizontal section taken generally along the line 2—2 in FIG. 1 to show the configuration of the underside of the sorting head or guide plate, with hatching added to the lowermost surface of the guide plate to more clearly identify the recessed areas, and with various coins superimposed thereon to illustrate the functions of the guide plate.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through central openings in a housing 11 and an annular sorting head or guide plate 12 inside the housing. As the coins pass through these openings, they are deposited on the top surface of a rotatable disc 13. This disc 13 is mounted for rotation on a stub shaft (not shown) and driven by an electric motor 14 via drive belt 15. The disc 13 comprises a resilient pad 16 bonded to the top surface of a solid metal disc 17. The top surface of the resilient pad 16 is preferably covered with a durable fabric bonded to the pad itself, which is preferably made of a resilient rubber or polymeric material.

As the disc 13 is rotated, the coins deposited on the top surface thereof tend to slide outwardly over the surface of the pad due to centrifugal force. As the coins move outwardly, those coins which are lying flat on the pad enter the gap between the pad surface and the guide plate 12 because the underside of the inner periphery of this plate is spaced above the pad 16 by a distance which is slightly substantially equal to or greater than the thickness of the thickest coin.

As can be seen most clearly in FIG. 2, the outwardly moving coins initially enter an annular recess 20 formed in the underside of the guide plate 12 and extending around a major portion of the inner periphery of the annular guide plate. Coins C1, C2 and C3 superimposed on the bottom plan view of the guide plate in FIG. 2 are examples of coins which have entered the peripheral recess 20. The outer wall 21 of the recess 20 extends downwardly to the lowermost surface 22 of the guide plate, which is spaced from the top surface of the pad 16 by a distance which is slightly less, e.g., 0.010 inch, than the thickness of the thinnest coins. Consequently, free radial movement of the coins is terminated when they engage the wall 21 of the recess 20, though the coins continue to move circumferentially along the wall 21 by the rotational movement of the pad 16, as indicated by the arrows in FIG. 2.

The only portion of the central opening of the guide plate 12 which does not open directly into the recess 20 is that sector of the periphery which is occupied by a raised land 23, the purpose of which will be described in more detail below. As coins within the recess 20 approach the leading edge 24 of the land 23, those coins move outwardly around the land 23 through a recess 25 which is merely an outward extension of the inner peripheral recess 20. In FIG. 2, coins C4, C5, C6 and C7 are examples of coins moving in succession through the recess 25, which is wide enough to accommodate coins of all denominations.

Figure 4:
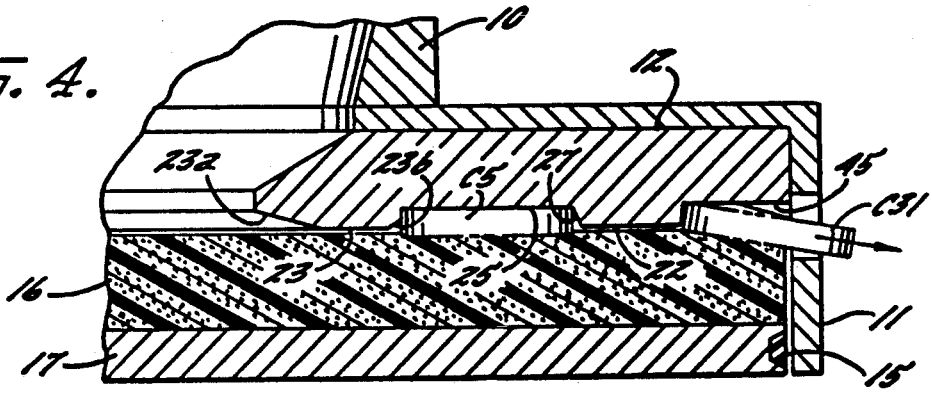
FIG. 4 is an enlarged section taken generally along line 4—4 in FIG. 2, showing the coins in full elevation.

The recess 25 extends entirely around the outer wall of the land 23 and rejoins the peripheral recess 20 at the downstream end 26 of the land 23. Just as the recess 25 is an extension of the peripheral recess 20, the outer wall 27 of the recess 25 is an extension of the outer wall 21 of the recess 20. Thus, coins which approach the recess 25 with their outer edges riding on the wall 21 move into the recess 25 with their outer edges riding on the outer wall 27, as illustrated by coins C4–C7 in FIG. 2. As can be seen in the sectional view in FIG. 4, the wall 27 is preferably tapered to minimize abrasion by minimizing the area of contact between the coins and the recess wall.

Figure 6:
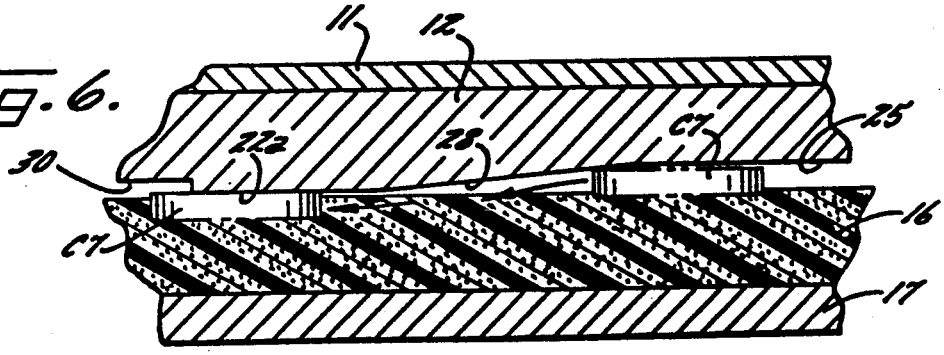
FIG. 6 is an enlarged section taken generally along line 6—6 in FIG. 2, showing two half dollars in full elevation at different positions along the section.

Rotation of the pad 16 continues to move the coins along the wall 27 until the outer portions of those coins engage a capturing ramp 28 sloping downwardly from the top surface of the recess 25 to a region 22*a* of the lowermost surface 22 of the guide plate 12. (For clarity, hatching has been added to the entire surface 22 in FIG. 2). Coin C7 in FIG. 2 is an example of a coin which has just engaged the ramp 28. Because the surface 22 is spaced from the pad 16 by a distance that is less than the thickness of the thinnest coin, the effect of the ramp 28 is to depress the outer edge of any coin that engages the ramp downwardly into the resilient pad 16 as the coins are advanced along the ramp by the rotating disc. As can be clearly seen from the sectional view in FIG. 6, this causes the coins to be firmly gripped between the guide plate surface region 22*a* and the resilient pad 16, thereby holding the coins in a fixed radial position as they continue to be rotated along the underside of the guide plate by the rotating disc.

Even though only a small portion of the surface area of any given coin is gripped between the guide plate surface region 22*a* and the resilient pad 16, the compressive gripping force is sufficient to hold the coins in a fixed radial position. In fact, gripping the coins along a segment which is only one millimeter wide is sufficient to hold the coins against radial movement, even while they are being rotated along the underside of the guide plate by the rotating disc.

As the coins continue to be rotated along region 22*a* of the guide plate surface, they enter a referencing recess 30 whose top surface is spaced away from the top of the pad 16 by a distance that is (1) less than the thickness of the thinnest coin but (2) slightly greater than the distance between the surface 22 and the top of the pad 16. For example, when the surface 22 is spaced 0.010 inch from the pad surface, the surface of the recess 30 is spaced 0.050 inch from the pad surface (the thickness of a dime is 0.053 inch). Consequently, the coins continue to be gripped between the guide plate 12 and the resilient pad 16 as they are rotated through the referencing recess 30. The purpose of the referencing recess 30 is to form an outer wall 31 for engaging and positioning the outer edges of the coins as they pass through the recess 30.

At the upstream of the recess 30, where the coins first enter the recess, the outer wall 31 is located at the same radial distance from the center of the guide plate as the outer edge of the ramp 28 (which is also the outermost portion of the outer wall 27 of the recess 25). Thus, the radial position of the coins is not changed when they first enter the referencing recess 30. As the coins move circumferentially through the referencing recess 30, however, the wall 31 cams the outer edges of the coins progressively inwardly, thereby re-referencing the outer edges of the coins to a different radial position that is slightly closer to the center of the guide disc. This camming action is illustrated by the progressive changes in the radial locations of the outer edges of the coins C8, C9, C10 and C11 in FIG. 2.

The reason for the re-referencing recess 30 is that certain coins may be captured by the ramp 28 even though they are not actually engaging the outer wall 27 of the recess 25. That is, the outer edge of a coin may be slightly spaced from the outer wall 27 as the coin engages the ramp 28, and yet that coin might still overlap a sufficient portion of the ramp 28 to become gripped between the guide plate surface 22 and the resilient pad 16. Inward movement of all the coins by the wall 31 ensures that the outer edges of all the coins are located at a common radial position, regardless of where the outer edges of those coins were located when they were initially captured by the ramp 28.

Figure 7:
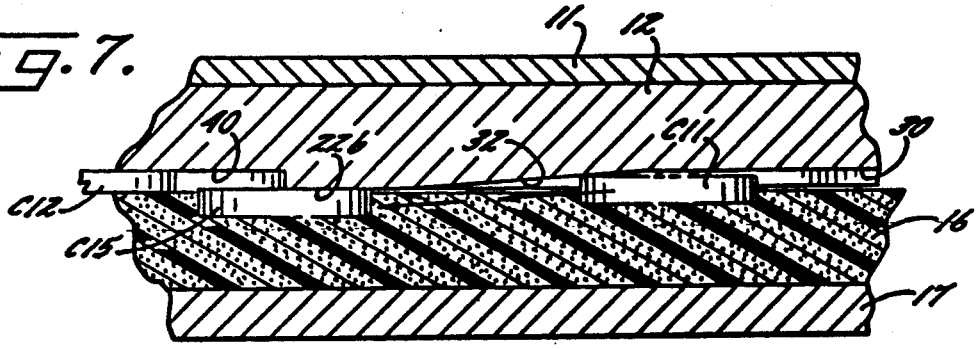
FIG. 7 is an enlarged section taken generally along line 7—7 in FIG. 2, showing two half dollars and a dime in full elevation at different positions along the section.

At the downstream end of the referencing recess 30, a gentle ramp 32 slopes downwardly from the top surface of the referencing recess 30 to region 22*b* of the lowermost surface 22 of the guide plate. Thus, the coins are gripped between the guide plate 12 and the resilient pad 16 with the maximum compressive force, as clearly illustrated in the sectional view in FIG. 7. This ensures that the coins are held securely in the new radial position determined by the wall 31 of the referencing recess 30.

In accordance with an important feature of the present invention, the guide plate 12 forms sorting means comprising a series of ejection recesses spaced circumferentially around the outer periphery of the plate, with the innermost edges of successive slots located progressively farther away from the common radial location of the outer edges of all the coins for receiving and ejecting coins in order of increasing diameter; the width of each ejection recess is smaller than the diameter of the coin to be received and ejected by that particular recess, and the surface of the guide plate adjacent the radially outer edge of each ejection recess presses the outer portions of the coins received by that recess into the resilient pad so that the inner edges of those coins are tilted upwardly into the recess. The ejection recesses extend outwardly to the periphery of the guide plate so that the inner edges of these recesses guide the tilted coins outwardly and eventually eject those coins from between the guide plate 12 and the resilient pad 16.

This feature of the invention stems in part from the discovery that coins can be reliably sorted and ejected at high throughput rates, while being pressed into the resilient pad, without the use of auxiliary coin-tilting devices such as depressors or plows. It has been found that with proper location and dimensioning of ejection recesses which are more narrow than the diameters of the respective coins to be ejected, the inner edges of the coins can be urged into the ejection recesses by the guide plate itself. Coins of different denominations are thus reliably ejected at designated circumferential locations around the periphery of the guide plate without the need for any auxiliary devices for ejecting the coins. It has been demonstrated that this arrangement permits sorting at rates in excess of 2500 coins per minute with less than 0.005% mis-sorted coins, without the use of any auxiliary devices for ejecting the coins.

In the illustrative embodiment of this invention, a series of six arcuate ejection recesses 40, 41, 42, 43, 44 and 45 are spaced circumferentially around the outer periphery of the guide plate 12. These six recesses 40–45 are positioned and dimensioned to eject dimes, pennies, nickels, quarters, dollars and half dollars, respectively. More specifically, the innermost edges of the ejection recesses are positioned so that the inner edge of a coin of only one particular denomination can enter each recess; the coins of all other remaining denominations extend inwardly beyond the innermost edge of that particular recess so that the inner edges of those coins cannot enter the recess. Thus, all the coins except the dimes bypass the recess 40.

For example, the first ejection recess 40 is intended to discharge only dimes, and thus the innermost edge **40*a* of this recess is located at a radius that is spaced inwardly from the radius of the referencing wall 31 by a distance that is only slightly greater than the diameter of a dime. Consequently, only dimes can enter the recess 40. Because the outer edges of all denominations of coins are located at the same radial position when they leave the referencing recess 30, the inner edges of the pennies, nickels, quarters, dollars and half dollars all extend inwardly beyond the innermost edge of the recess 40, thereby preventing these coins from entering that particular recess. This is illustrated in FIG. 2 which shows dimes C12 and C13 captured in the recess 40, while a penney C14 and half dollar C15 are bypassing the recess 40 because their inner edges extend inwardly beyond the innermost edge 40*a*** of the recess.

At recess 41, the inner edges of only the pennies are located close enough to the periphery of the guide plate 12 to enter the recess. The inner edges of all the larger coins extend inwardly beyond the innermost edge of the recess 41 so that they remain gripped between the guide plate and the resilient pad. Consequently, all the coins except the pennies continue to be rotated past the recess 41. This is illustrated in FIG. 2 which shows pennies C16, C17 and C18 captured in the recess 41, while a nickel C19 is bypassing the recess 41 because the inner edge of the nickel overlaps the innermost edge **41*a*** of the recess.

Similarly, only the nickels (e.g., C20, C21 and C22) enter the ejection recess 42, only the quarters (e.g., C23, C24 and C25) enter the recess 43, only the dollars (e.g., C26, C27 and C28) enter the recess 44, and only the half dollars (e.g., C29, C30 and C31) enter the recess 45. FIG. 2 also shows a quarter C32 bypassing the nickel recess 42, a dollar C33 bypassing the quarter recess 43, and a half dollar C34 bypassing the dollar recess 44.

Figure 8:
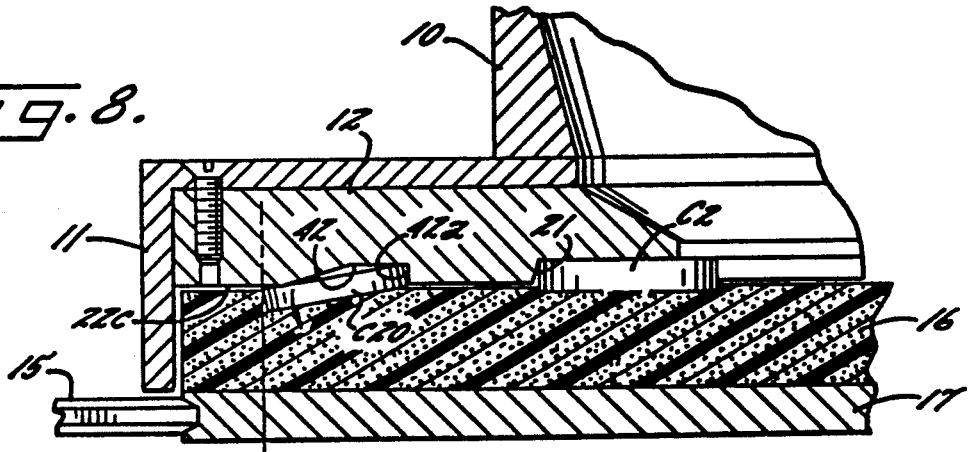
FIG. 8 is an enlarged section taken generally along line 8—8 in FIG. 2, showing a nickel registered with the ejection recess.

The cross-sectional profile of the ejection recesses 40–45 is shown most clearly in FIG. 8, which is a section through the nickel recess 42. Of course, the cross-sectional configurations of all the recesses are similar; they vary only in their widths and their circumferential and radial positions. As can be clearly seen in FIG. 8, the recess slot 42 has a width which is greater than the radius, but less than the diameter, of the nickel C20. Consequently, the outer portion of the nickel is pressed downwardly into the resilient pad 16 by region **22*c* of the guide plate surface 22 at the outer edge of the recess 42, thereby causing the inner edge of the nickel to be tilted upwardly into the recess 42 with the inner edge of the nickel riding along the inner wall 42*a* of the recess. Then, as the nickel is moved circumferentially along the surface of the guide plate, the wall 42*a* of the recess 42 cams the nickel outwardly until it reaches the periphery of the guide plate 12** and is eventually released entirely from the gripping pressure of the guide plate and the resilient pad. At this point centrifugal force causes the coin to move radially away from the sorting mechanism into a suitable receptacle, such as a coin bag or box.

Because each coin is gripped between the guide plate 12 and the resilient pad 16 throughout its movement through the ejection recess, the coins are under control at all times. Thus, any coin can be stopped at any point along the length of its ejection recess, even when the coin is already partially projecting beyond the outer periphery of the guide plate. Consequently, no matter when the rotating disc is stopped (e.g., in response to the counting of a preselected number of coins of a particular denomination), those coins which are already within the various ejection recesses can be retained within the sorting head until the disc is re-started for the next counting operation.

Figure 9:
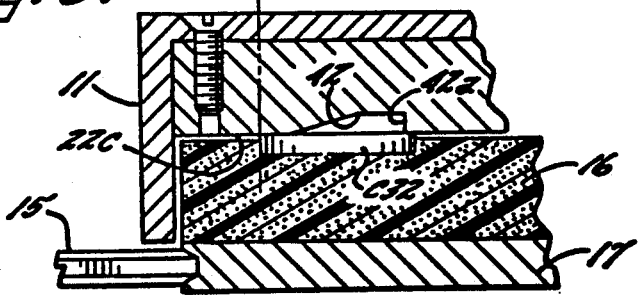
FIG. 9 is a portion of the same section shown in FIG. 8 but with a quarter rather than a nickel registered with the ejection recess.

FIG. 9 is a portion of the same section shown in FIG. 8 with a quarter C32 rather than the nickel C20 positioned over the ejection recess 42. It can be seen that the inner edge of the quarter extends inwardly beyond the inner edge **42*a* of the recess 42, which prevents the quarter from entering the recess. Consequently, the quarter C32 continues to be advanced in the circumferential direction by the rotating disc until the quarter comes into register with the next ejection recess 43**.

Figure 14:
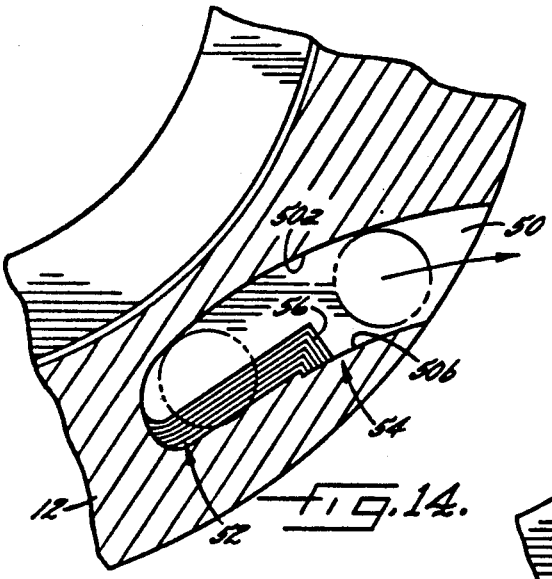
FIG. 14 illustrates a portion of the underside of the guide plate having an ejection recess with coins superimposed thereon to illustrate the functions of the ejection recess; p

FIGS. 14–18 illustrate alternate shapes for the ejection recesses. The ejection recesses 50,60,70 function similarly to the previously described ejection recesses 40–45, and provide various advantages. FIG. 14 illustrates an ejection recess 50 which has a radially inboard portion 52 which is similar to the previously described ejection recesses 40–45. The radially inboard portion 52 captures coins by tilting their innermost edges into the recess 50. To increase the speed of the exiting coins as compared with the ejection recesses 40–45, a radially outboard portion 54 of the recess 50 widens to allow the coin to travel between the innermost edge 50*a* and the outermost edge 50*b* of the recess 50. A ramp 56 tapers upwardly from the surface 22 of the plate to the ceiling of the recess 50 to provide a smooth transition for coins traveling in the recess 50, and to substantially release the coins from the pressure of the pad.

The tangential velocity of coins exiting under pad pressure along an edge which is curved along an arc which intersects the direction of rotation of the rotating pad 16 diminishes due to the force applied t the coin by the edge. Therefore, coins in ejection recesses of this type tend to slow and abut one another. If an adequate backlog of coins develops, the reference position of abutting coins which have not yet reached the entrance to the recess will be altered, causing the altered coins to mis-sport. The recess 50 captures the coins, and then substantially releases them from the pressure of the pad as the edge 50*a* curves toward the periphery of the plate, so that coins tend to travel faster through the ejection recess 50. Moreover, should coins abut one another in the ejection recess 50, they push the coins in the outboard portion 54 out of the ejection recess 50, since the coins in the outboard portion 54 of the recess 50 are under less pressure.

Figure 16:
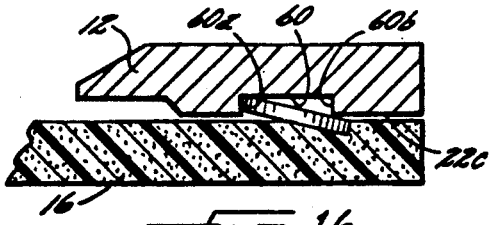
FIG. 16 is an enlarged section taken generally along line 16—16 in FIG. 15, showing the coins in full elevation.
Figure 15:
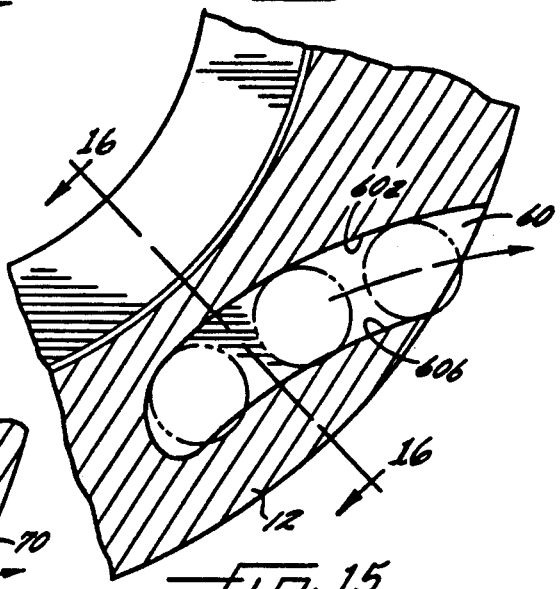
FIG. 15 illustrates a portion of the underside of the guide plate having an ejection recess with coins superimposed thereon to illustrate the functions of the ejection recess.

FIGS. 15 and 16 illustrate another embodiment of an ejection recess 60 which is narrower than the diameter of the coin to be received and ejected by the recess 60. The recess 60 captures, guides, and ejects coins in the same manner as the ejection recesses 40–45. However, the outermost wall 60*b* does not gently taper from the surface 22*c* to the ceiling 60*c* of the recess 60. Instead, the outermost wall 60*b* is substantially perpendicular to the ceiling 60*c* of the recess 60. This construction greatly reduces the time and expense of machining the plate 12, since the perpendicular wall 60*b* is much easier to fabricate than the sloping wall in the previously described recesses 40–45. This reduction in machining time and cost increases as the number of ejection recesses per plate 12 increases.

Figure 17:
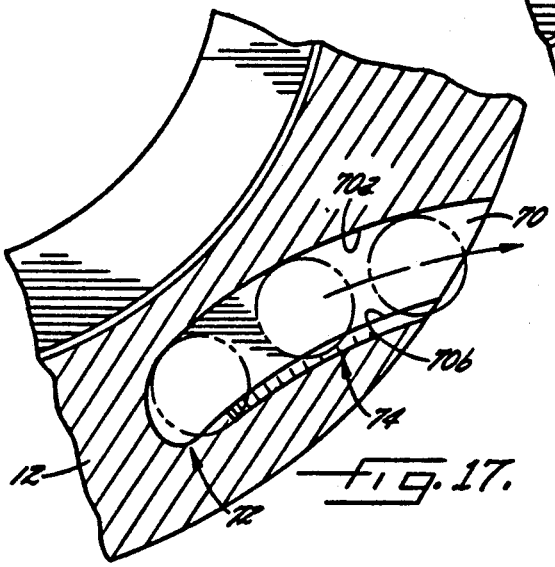
FIG. 17 illustrates a portion of the underside of the guide plate having an ejection recess with coins superimposed thereon to illustrate the functions of the ejection recess.
Figure 18:
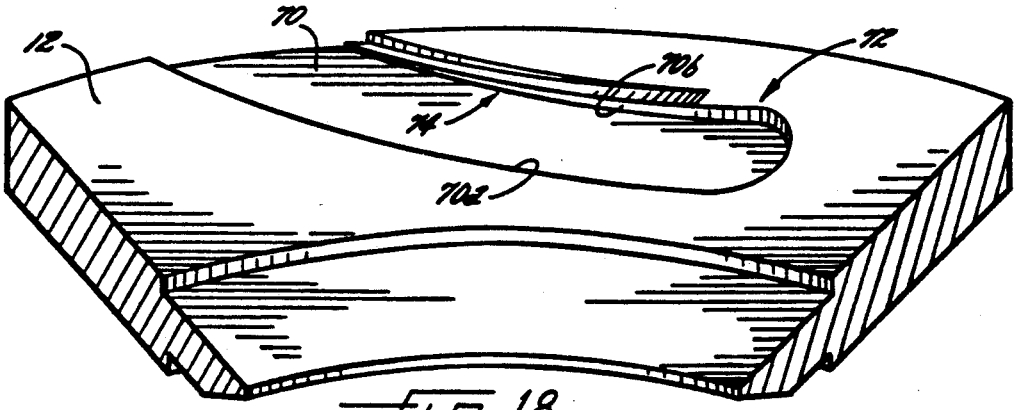
FIG. 18 is a perspective view of the underside portion of the guide plate illustrated in FIG. 17.

To facilitate the counting of thick coins, FIGS. 17 and 18 illustrate yet another embodiment of an ejection recess 70 which includes a coin capturing portion 71 and a ramping portion 74. International currencies include coins which are thicker than the coins used in U.S. currency. A problem arises when thick (e.g., greater than 0.100 inch) coins exit from the recesses 40–45 to be counted by proximity sensors or photocells. These types of sensors typically have a gap of a few hundred thousandths of an inch through which an ejected coin may pass. The recesses 40–45 eject coins in a tilted orientation, so that sensors which are mounted to accept coins being ejected parallel to the surface of the pad may not have a gap wide enough to accept coins being ejected in a tilted orientation with respect to the pad. Tilted coins can strike and damage the sensor, or become wedged into the gap of the sensor.

The ejection recess 70 ejects coins substantially parallel with the surface of the pad 16. The capturing portion 72 of the recess 70 apertures incoming coins in the same manner as the ejection recesses 40–45 by tilting the coins into the recess 70. The outermost wall 70*b* forms a ramping portion 74 which carries the outermost edge of the coin upwardly toward the end of the ejection recess 70, and keeps the coin under pad pressure for substantially the length of the recess. As a result, the coin leaves the ejection recess 70 substantially parallel to the pad 16.

Returning now to the function of the land 23, the primary function of this portion of the guide plate 12 is to prevent two or more coins stacked on top of each other from reaching the ramp 28. When two or more coins are stacked on top of each other, they may be pressed into the resilient pad 16 even within the deep peripheral recess 20. Consequently, stacked coins can be located at different radial positions within the recess 20 as they approach the land 23. Coins C35 and C36 represent one example of such a pair of stacked coins.

Figure 3:
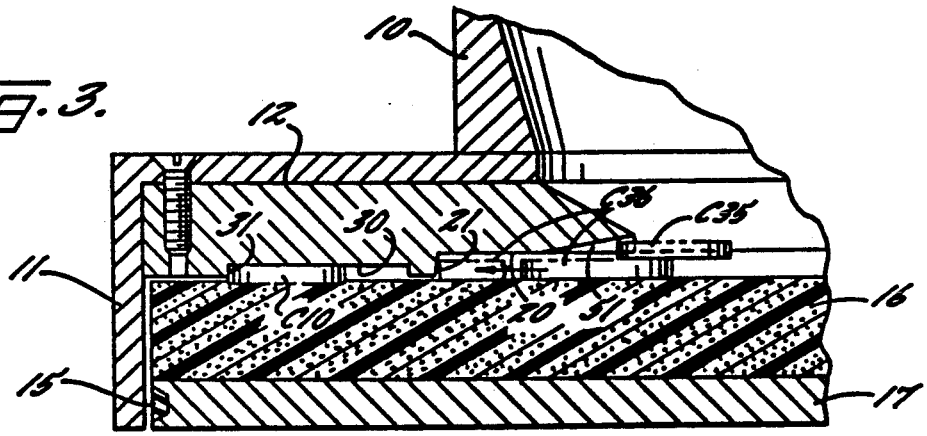
FIG. 3 is an enlarged section taken generally along line 3—3 in FIG. 2, showing the coins in full elevation.
Figure 10:
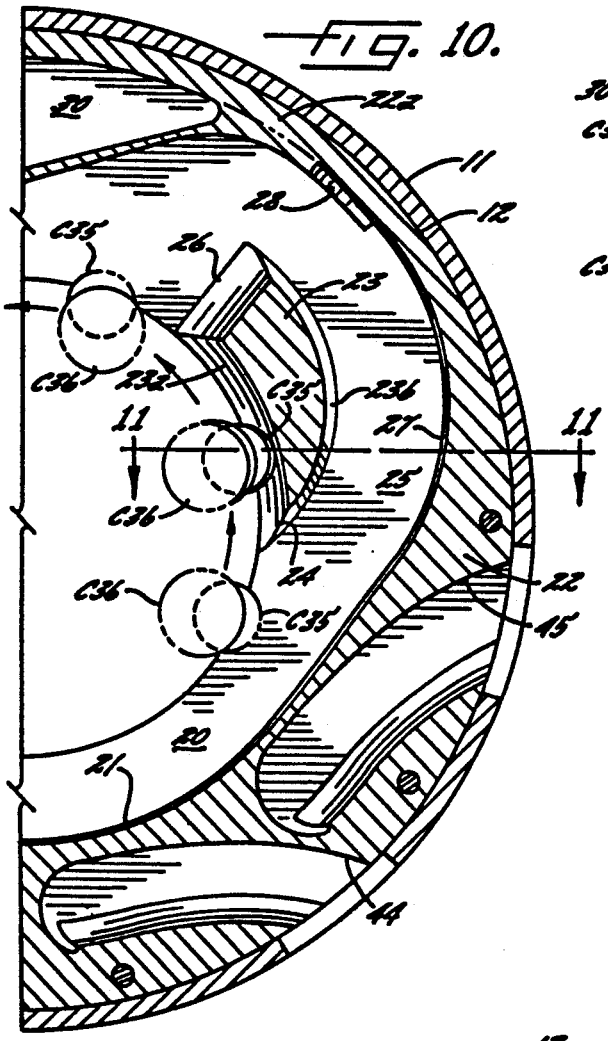
FIG. 10 is the righthand half of FIG. 2 with certain coins superimposed thereon to illustrate the recycling of stacked coins.
Figure 11:
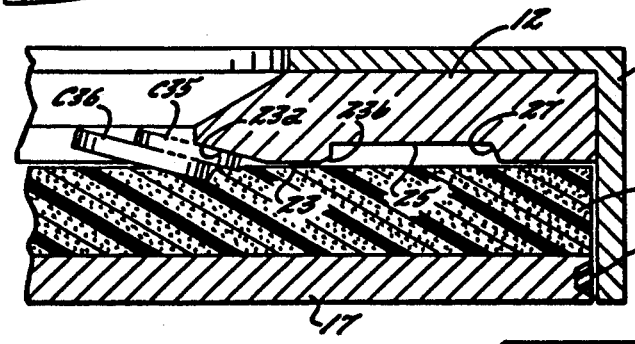
FIG. 11 is an enlarged section taken generally along line II—II in FIG. 10.

FIG. 10 illustrates a pair of stacked coins which have only partially entered the recess 20 and, therefore, engage the inner wall 23*a* of the land 23. As can be seen most clearly in the cross-sectional view in FIG. 11, the inner wall 23*a* is beveled so that stacked coins which have only partially entered the recess 20, such as the exemplary pair of coins C35 and C36, are allowed to bypass the land 23 by passing beneath the beveled wall 23*a*. It can be seen that the beveled wall 23*a* tilts the stacked coins C35 and C36 as they pass thereunder, thereby retaining the stacked coins in their original radial positions partially within the recess 20. Consequently, when the stacked coins emerge from the downstream end of the island 23, they are in position to engage a notch 50 formed in the inner periphery of the guide plate (see FIG. 2). When the stacked coins engage the notch 50, the upper coin C35 engages the wall 51 of the notch, which retards the upper coin C35 while the lower coin C36 continues to be advanced by the rotating disc. Thus, the stacked coins are stripped apart so that they can once again enter the recess 20, this time in a single layer. The stripping action of the notch 50 is clearly illustrated in the sectional view of FIG. 3.

Figure 5:
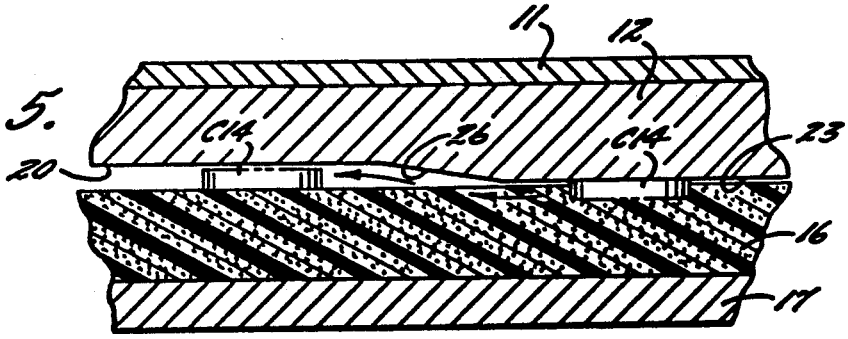
FIG. 5 is an enlarged section taken generally along line 5—5 in FIG. 2, showing two pennies in full elevation at different positions along the section.
Figure 12:
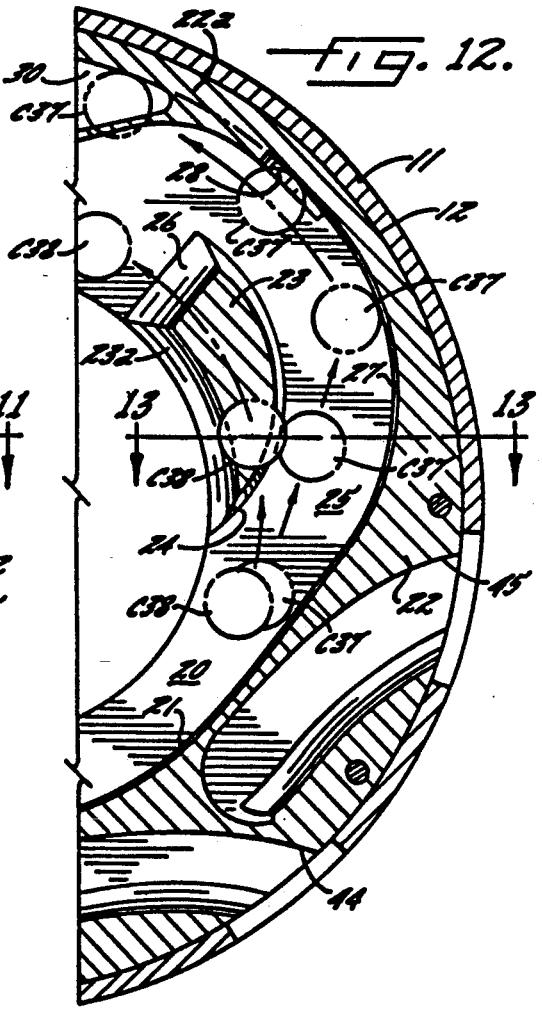
FIG. 12 is the righthand portion of FIG. 2 with certain coins superimposed thereon to illustrate the destacking of stacked coins and their subsequent travel paths around that portion of the guide plate.
Figure 13:
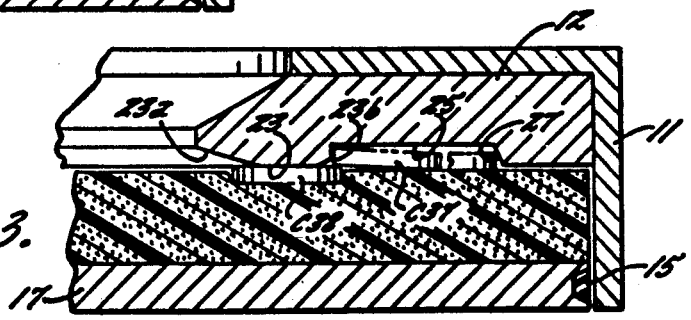
FIG. 13 is an enlarged section taken generally along line 13—13 in FIG. 12.

FIG. 12 illustrates a stacked pair of coins C37 and C38 which have moved farther out, in the radial direction, within the recess 20 before reaching the land 23. This pair of stacked coins engages the outer wall 23*b* of the land 23; as clearly illustrated in FIG. 13, the lower portion of this wall 23*b* forms a short bevel while the upper portion is vertical. Thus, the upper coin C37 engages the vertical upper portion of the wall 23*b* and is thereby cammed outwardly into the recess 25. The lower coin C38 engages the beveled lower portion of the 23*b* wall which presses the coin C38 into the resilient pad 16 so that it can pass beneath the land 23. Pressure between the land 23 and the resilient pad 16 maintains the lower coin C38 in a fixed radial position as it passes beneath the land 23 so that coin is recycled into the recess 20 as the pad continues to rotate, as shown most clearly in the sectional view of FIG. 5. With the upper coin C37 being cammed outwardly into the recess 25, while the lower coin C38 is maintained in a fixed radial position, the two C37 and C38 coins are stripped apart. The upper coin C37 is then free to move outwardly by centrifugal force to the guide wall 27 and onto the ramp 28 while the lower coin is recycled.

What is claimed is:

1. A coin sorter for sorting coins by their diameter, comprising:

a rotatably mounted coin-carrying disc having a resilient top surface onto which coins may be fed;

means for rotating said disc;

a guide plate having a surface positioned over and closely adjacent said disc, wherein said surface includes an inner recess within which coins are able to move radially in response to rotation of said disc;

means for allowing coins to enter between said disc and said plate;

referencing means configured in said surface for engaging the radially outer edges of coins as said coins are moved circumferentially between said disc and said plate to position the radially outer edges of said coins at a common radial location, whereby the radially inner edges of said coins are positioned at different radial locations determined by the diameters of the respective coins;

sorting means including a series of circumferentially spaced ejection recesses formed in said guide plate with the radially inner edges of successive ejection recesses located at different radial positions for receiving the inner portions of coins of progressively increasing diameter, the width of each ejection recess being smaller than the diameter of the coin to be received by that recess and the surface of the guide plate adjacent the radially outer edge of each ejection recess pressing the outer portions of the coins into said resilient top surface of said disc so that the inner edges of the coins received by each respective ejection recess are tilted upwardly into that recess, said ejection recesses extending outwardly to the periphery of said guide plate so that the inner edges of the recesses guide the tilted coins outwardly and eject those coins from between said disc and said guide plate.

2. A coin sorter as set forth in claim 1 wherein each of said ejection recesses is curved outwardly toward the periphery of said guide plate and away from the circumferential path of movement of coins approaching the ejection recess.

3. The coin sorter as set forth in claim 1, wherein said referencing means engages the radially outer edges of coins of all denominations as the coins are moved circumferentially between said disc and said plate to position the radially outer edges of the coins of all denominations at a common radical location, whereby the radially inner edges of coins of different denominations are positioned at different radial locations determined by the diameters of the respective coins.

4. The coin sorter as set forth in claim 3, wherein said sorting means further includes:

a series of circumferentially spaced ejection recesses formed in said guide plate with the radially inner edges of successive ejection recesses located at different radial positions for receiving the inner portions of coins of progressively increasing diameter.

5. The coin sorter as set forth in claim 1, wherein the width of the radially outer portion of said ejection recess is greater than the diameter of the coin to be received therein.

6. The coin sorter as set forth in claim 5, wherein said ejection recess, as it widens, substantially releases coins of said first denomination traveling through said recess toward the periphery of said guide plate from the pressure of said resilient top surface.

7. A coin sorter for sorting coins in terms of their diameter comprising:

a rotatably mounted coin-carrying disc having a resilient top surface onto which coins may be fed;

means for rotating said disc;

a guide plate having a central opening and a lower surface positioned over and closely adjacent to said disc, and wherein said lower surface includes an inner recess within which coins are able to move radially, and said inner recess extends outwardly from said central openings, referencing means for engaging the radially outer edges of the coins of all denominations as said coins are moved circumferentially on said disc beneath the lower surface of said guide plate to position the radially outer edges of the coins of all denominations at a common radial location, whereby the radially inner edges of the coins are positioned at different radial locations determined by the diameters of the respective coins, and sorting means receiving coins positioned by said referencing means, said sorting means comprising a series of circumferentially spaced ejection recesses formed around the outer periphery of said guide plate and extending inwardly from said outer periphery to form inner ends spaced inwardly from said outer periphery, the radially inner edges of the inner ends of successive ejection recesses being located at different radial positions for receiving the inner portions of coins of progressively increasing diameter, the width of each ejection recess being smaller than the diameter of the coin to be received by that recess and the surface of the guide plate adjacent the radially outer edge of each ejection recess pressing the outer portions of the coins of all denominations into said resilient top surface of said disc so that the inner edges of the respective coins received by each ejection recess are tilted upwardly into that recess, said ejection recesses extending outwardly to the periphery of said guide plate so that the inner edges of the recesses guide the tilted coins outwardly and eject those coins from between said disc and said guide plate.

8. A coin sorter as set froth in claim 7 wherein each of said ejection recesses is curved outwardly toward the periphery of said guide plate and away from the circumferential path of movement of coins approaching the ejection recess.

9. A coin sorter as set forth in claim 7 wherein said guide plate includes means for arranging coins in said inner recess in a single file of single-layer coins.

10. A coin sorter as set forth in claim 7 wherein said guide plate forms a lowermost surface for pressing coins against the resilient to surface of said coin-carrying disc, said lowermost surface intercepting the outer edge of said inner recess and extending inwardly therefrom, said guide plate also forming a ramp between said inner recess and said lowermost surface for gradually pressing coins approaching said lowermost surface into said resilient surface.

11. A coin sorter as set forth in claim 10 wherein said referencing means is formed by a recess in said lowermost surface, the radially outer edge of said recess being positioned and shaped to engage the radially outer edges of the coins of all denominations and moving said coins radially inwardly as the coins are advanced circumferentially through said recess.

12. A coin sorter as set forth in claim 7 wherein said coin-carrying disc extends beneath said guide plate surface adjacent the radially outer edge of each ejection recess, and said guide plate surface is spaced from said resilient top surface of said disc.

13. A coin sorter as set forth in claim 12 wherein the space between said resilient top surface and said guide plate surface adjacent the radially outer edge of each ejection recess is less than the thickness of the thinnest coin to be sorted.

14. A coin sorter for sorting coins in terms of their diameter comprising:

a rotatably mounted coin-carrying disc having a resilient top surface onto which coins may be fed;

means for rotating said disc;

a guide plate having a central opening and a lower surface positioned over and closely adjacent to said disc, and wherein said lower surface includes an inner recess within which coins are able to move radially, and said inner recess extends outwardly from said central opening, referencing means for engaging one edge of the coins of all denominations as said coins are moved circumferentially on said disc beneath the lower surface of said guide plate, said reference means positioning the engaged edges of the coins at a common radial location, whereby the opposite edges of the coins are positioned at different radial locations determined by the diameters of the respective coins, and sorting means receiving coins positioned by said referencing means, said sorting means comprising a series of circumferentially spaced ejection recesses formed around the outer periphery of said guide plate and extending inwardly from said outer periphery to form inner ends spaced inwardly from said outer periphery, one of the edges of the inner ends of successive ejection recesses being located at different radial positions for receiving said opposite edges of coins of progressively increasing diameter the width of each ejection recess being smaller than the diameter of the coin to be received by that recess and the surface of the guide plate adjacent the coin-receiving edge of each ejection recess pressing the portions of the coins extending beyond the width of the ejection recess into said resilient top surface of said disc so that the edges of the respective coins received by each ejection recess are tilted upwardly into that recess, said ejection recesses extending outwardly to the periphery of said guide plate so that the recesses guide the tilted coins outwardly and eject those coins from between said disc and said guide plate.

15. A coin sorter, comprising:

a rotatably mounted coin-carrying disc having a resilient top surface onto which coins may be fed;

means for rotating said disc;

a guide plate having a surface positioned over and closely adjacent said disc, wherein said surface includes an inner recess within which coins are able to move radially in response to rotation of said disc;

means for allowing coins to enter between said disc and said plate;

referencing means configured in said surface for engaging the edges of coins as the coins are moved circumferentially between said disc and said plate to position the radially outer edges of coins of a first denomination at a common radial location;

sorting means including an ejection recess formed in said guide plate with the radially inner edge of said ejection recess located at a radial location for receiving the radially inner portion of coins of said first denomination, the width of said ejection recess initially being smaller than the diameter of the coin to be received and the surface of the guide plate adjacent the radially outer edge of said ejection recess pressing the outer portions of the coins into said resilient top surface of said disc so that the inner edges of the coins received by said ejection recess are tilted upwardly into said recess, said ejection recess extending outwardly to the periphery of said guide plate so that the inner edge of the recess guides the coins outwardly and ejects the coins from being said disc and said guide plate, the radially outer edge of said ejection recess sloping upwardly to gradually release the coins of said first denomination from the pressure of said resilient top surface of said disc.

* * * * *